United States Patent [19]

Townsend

[11] 4,164,055

[45] Aug. 14, 1979

[54] CLEANING AND DISINFECTING HARD SURFACES

[75] Inventor: Robert L. Townsend, Irvine, Calif.

[73] Assignee: Purex Corporation, Lakewood, Calif.

[21] Appl. No.: 853,747

[22] Filed: Nov. 21, 1977

Related U.S. Application Data

[62] Division of Ser. No. 786,352, Apr. 11, 1977.

[51] Int. Cl.[2] ..... A47L 7/00

[52] U.S. Cl. ..... 15/321; 15/353; 15/401

[58] Field of Search ..... 15/320, 321, 322, 339, 15/353, 401

[56] References Cited

U.S. PATENT DOCUMENTS

| | | | |
|---|---|---|---|
| 965,315 | 7/1910 | Moorehead | 15/322 |
| 1,016,345 | 2/1912 | Overholt | 15/321 X |
| 1,849,663 | 3/1932 | Finnell | 15/401 |
| 3,019,462 | 2/1962 | Nash et al. | 15/401 X |
| 3,896,520 | 7/1975 | Williams | 15/320 |
| 3,896,521 | 7/1975 | Parise | 15/322 X |
| 3,962,745 | 6/1976 | Collier | 15/322 |

FOREIGN PATENT DOCUMENTS

| | | | |
|---|---|---|---|
| 584806 | 10/1959 | Canada | 15/321 |

*Primary Examiner*—Christopher K. Moore
*Attorney, Agent, or Firm*—William W. Haefliger

[57] ABSTRACT

Suction and germicidal spray producing apparatus effects rapid removal of soils and bacteria from hard surface floors in both dry and wet states, the removed dry and wet soils and bacteria being isolated and confined; the apparatus includes a head assembly carrying longitudinally spaced, resiliently flexible strips extending in parallel relation to engage the floor surface, the head assembly including support means to engage the floor surface; means is provided for applying suction to the space between the strips; and means is provided for applying cleaning liquid to the floor surface to wet that surface visibly and openly outside the space between the strips, so that the user moving the head assembly back and forth can controllably move the head and strips over the surface to assure suction removal of liquid, soils and bacteria on the floor surface, to be conducted away from the head assembly.

10 Claims, 12 Drawing Figures

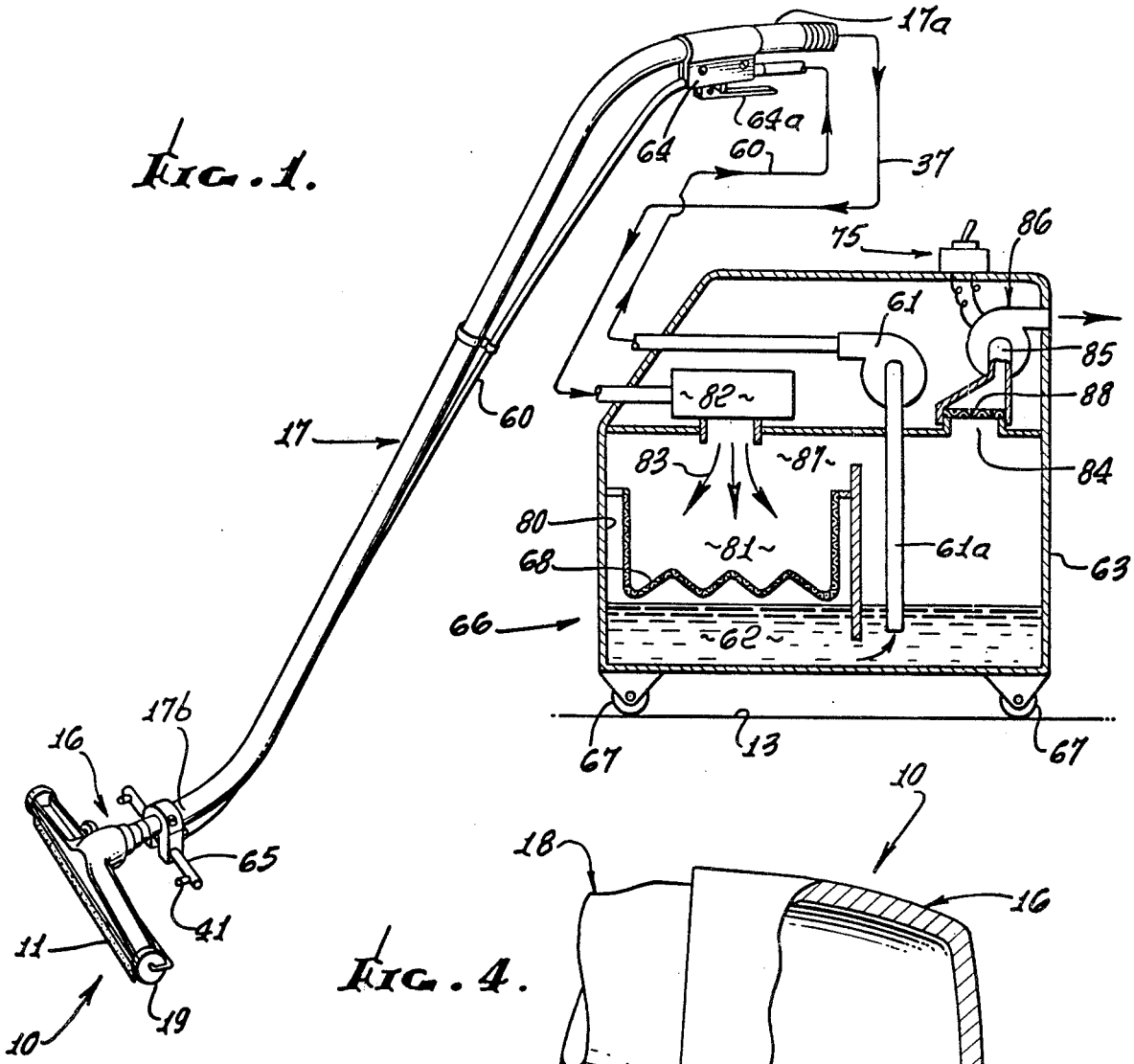
FIG. 1.
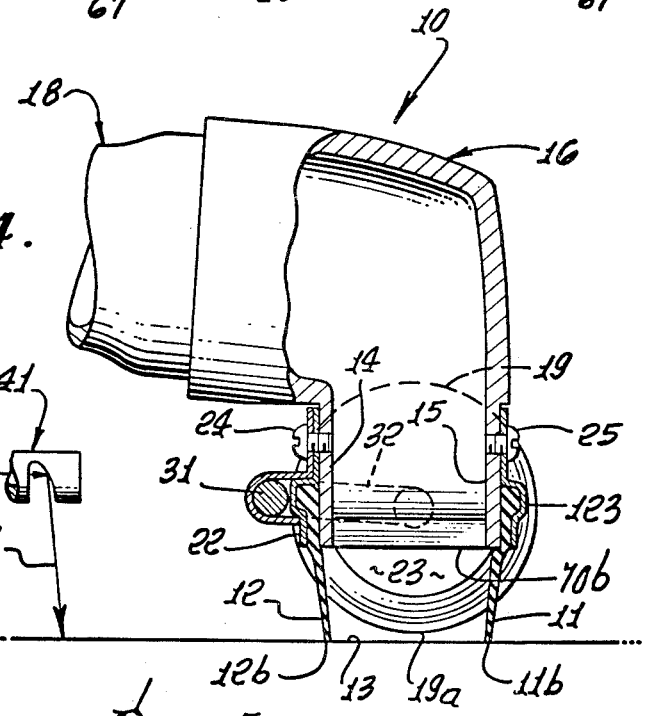
FIG. 4.
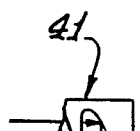
FIG. 5.
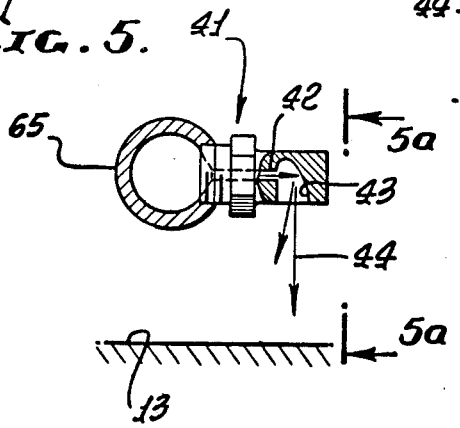
FIG. 5a.
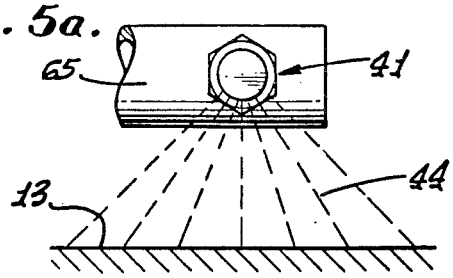

CLEANING AND DISINFECTING HARD SURFACES

This is a division of application Ser. No. 786,352, filed Apr. 11, 1977.

BACKGROUND OF THE INVENTION

This invention relates generally to removal of soil and bacteria from hard surface floors; more particularly, it concerns method and apparatus to accomplish such removal, and employing both suction and spray producing means in a novel and highly effective manner.

In the past, primary reliance has been placed upon wet mopping to clean hard surfaced floors, as for example in hospitals, stores, and restaurants. Disadvantages with this well known procedure are numerous, and include the inability to remove the film of liquid left on the floor, whereby bacteria in such films are not removed; unsanitary conditions associated with wringing of the mop; and inability to reach floor corner areas. While various expedients have been proposed, none to my knowledge provide the unusually advantageous results and structural combinations of the present invention, which make use of the tool simple, effective and rapid, for cleaning hard surface floors. For example, Canadian Pat. No. 899,574 disclosed a vacuum cleaner floor tool operating to remove soils from surfaces such as carpets; however, no provision was there made for removal of bacteria and wet films on hard surfaced flooring, in the highly advantageous manner as now proposed.

SUMMARY OF THE INVENTION

It is a major object of the present invention to provide apparatus and method overcoming the deficiencies associated with prior hard floor surface cleaning methods. As will be seen, the invention has particularly advantageous use for cleaning hospital floors and corridors as well as other floor surface areas, and is characterized by elimination of need for mops, wet vacuums and floor scrubbers; it provides increased safety under foot and reduces maintenance work. In addition, it enables savings in water usage of up to 50%, as compared with the mop and bucket method.

In its broadest apparatus aspects, the invention comprises;

(a) a head assembly including two upright, longitudinally spaced, resiliently flexible strips extending generally laterally horizontally in parallel relation; the strips projecting downwardly to engage the floor surface, (b) means for applying suction to the space between the strips;

(c) the head assembly including support means to engage the floor while the head assembly is bodily displaced longitudinally in one direction with the strips in such proximity to the floor surface that their lower edge portions are flexed in the opposite direction, whereby the leading strip in said one direction passes loose soils relatively therebeneath into the space between the strips for suction removal from said space, and (d) means for applying cleaning liquid to the floor surface to wet that surface in such spaced relation to the strips that when the head assembly and strips are bodily displaced in the opposite longitudinal direction the lower portions of the strips flex relatively in said one direction and the leading strip in said opposite direction passes applied liquid relatively therebetween into the space between the strips for suction removal from said space.

These and other objects and advantages of the invention, as well as the details of an illustrative embodiment, will be more fully understood from the following description and drawings, in which

DRAWING DESCRIPTION

FIG. 1 is a perspective view of floor cleaning apparatus embodying the invention;

Figure 2:
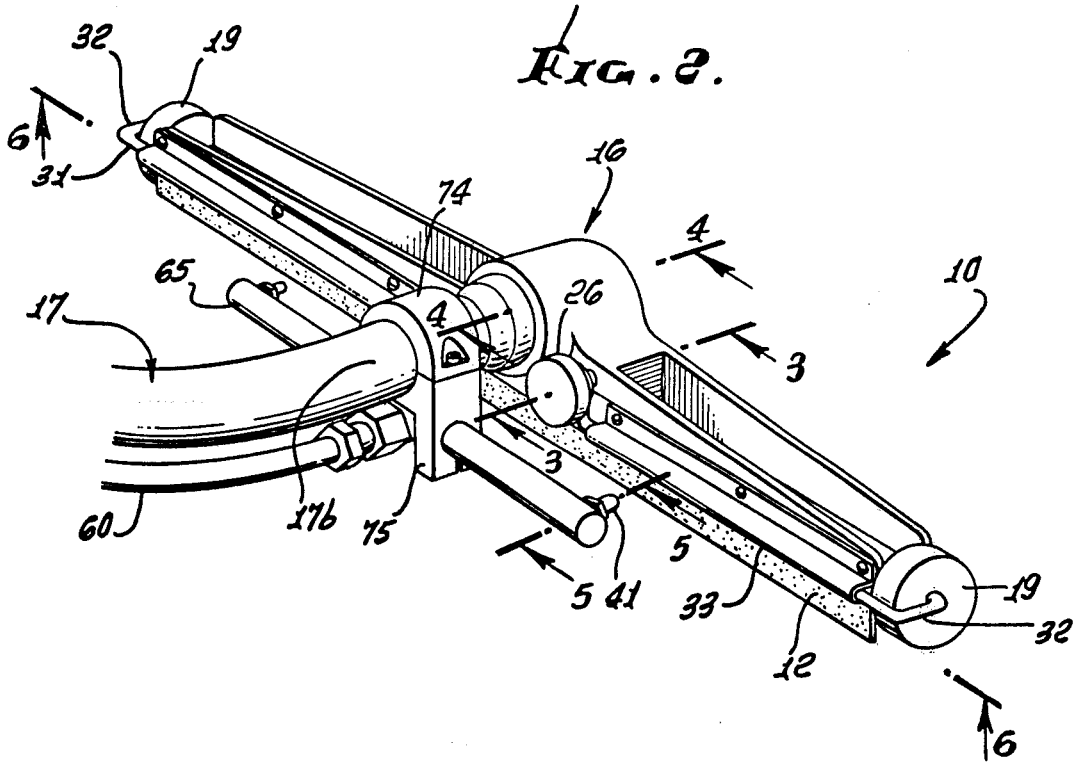
FIG. 2 is an enlarged perspective view of the floor cleaning head assembly.
Figure 3:
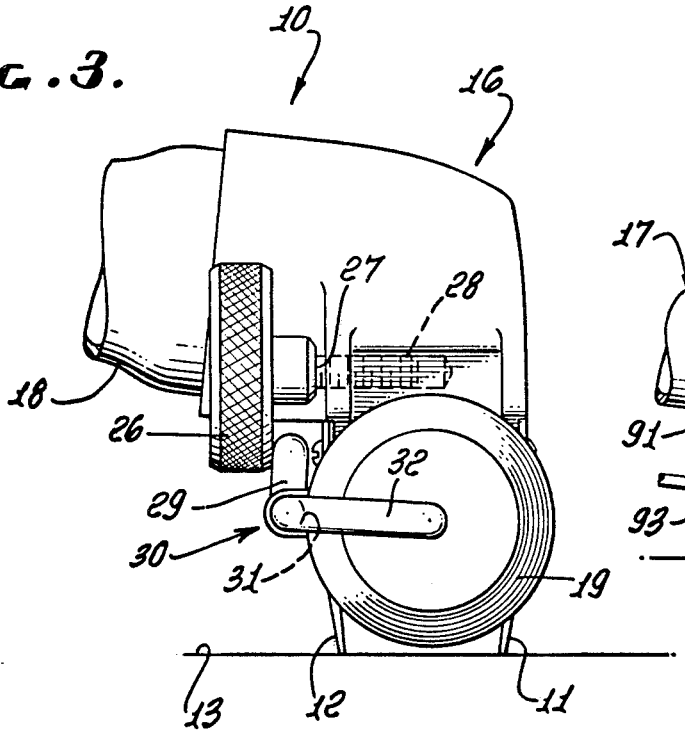
FIG. 3 is an enlarged elevational view taken on lines 3—3 of FIG. 2.
Figure 3A:
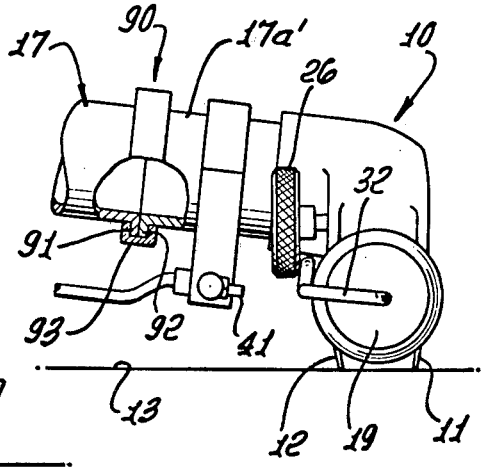
Figure 6:
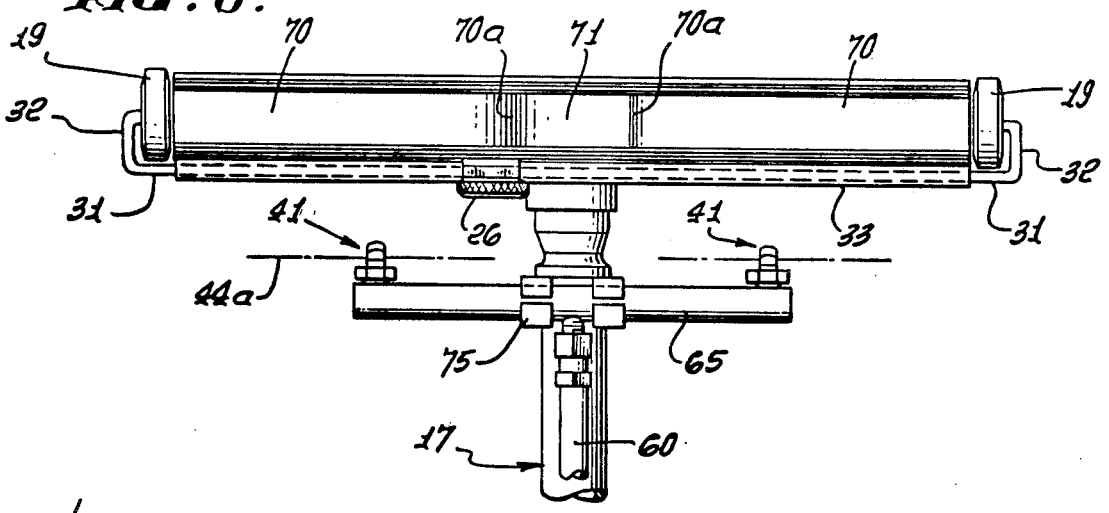
Figure 7:
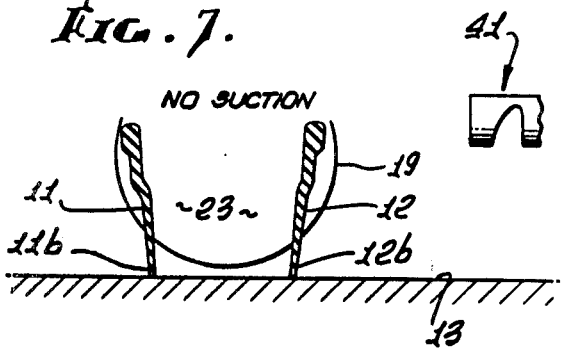
Figure 8:
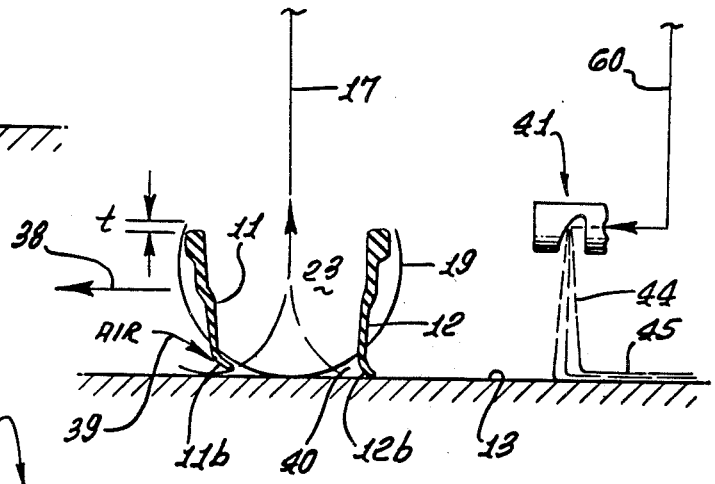
Figure 9:
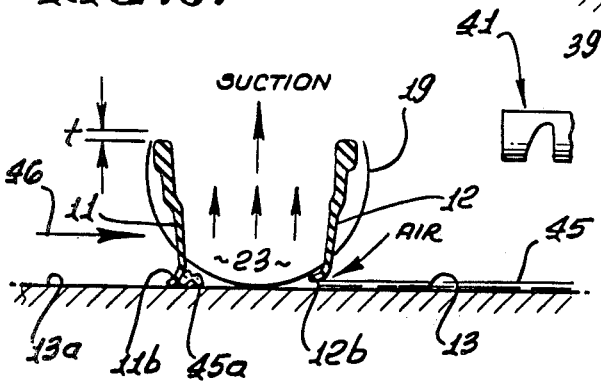
Figure 10:
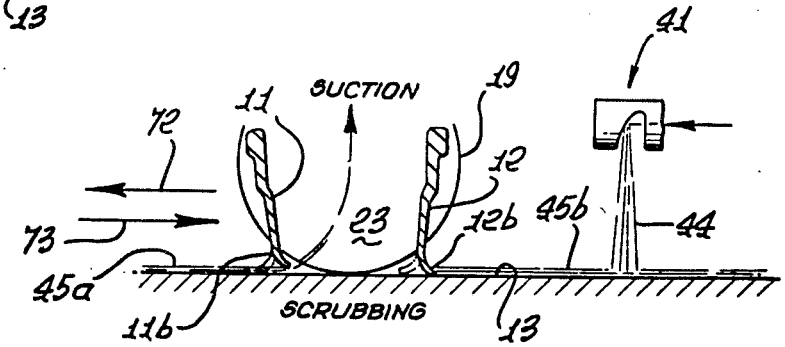

FIG. 3*a* is a view like FIG. 3, showing a modification;

FIG. 4 is an enlarged elevation view taken in section on lines 4—4 of FIG. 2;

FIG. 5 is an enlarged elevation view taken in section on lines 5—5 of FIG. 2;

FIG. 5*a* is an end view taken on line 5*a*—5*a* of FIG. 5;

FIG. 6 is a bottom plan view taken on lines 6—6 of FIG. 2;

FIG. 7 is a schematic showing of the head assembly flexible strips relative to a floor surface under conditions of no suction applied to the head assembly;

FIG. 8 is a schematic showing similar to FIG. 7, with suction applied and the head assembly moving in one direction;

FIG. 9 is a schematic showing similar to FIG. 7, with suction applied and the head assembly moving in the opposite direction; and FIG. 10 is a schematic showing similar to FIG. 7, with suction applied and the head assembly moved back and forth in scrubbing mode.

DETAILED DESCRIPTION

In the drawings, a head assembly 10 is shown to include two longitudinally spaced, resiliently flexible strips 11 and 12 extending generally horizontally in parallel relation. The strips are shown in FIG. 4 as projecting downwardly to engage the floor surface 13 at 11*b* and 12*b*, and they may consist of rubber or other elastomeric material. The head assembly may also include laterally elongated, downwardly opening structure as defined by walls 14 and 15 and a hollow gooseneck 16 intermediate the laterally opposite ends of the head assembly. An elongated, tubular handle 17 is connected at 18 to the gooseneck, and has S-shape, the upper extent 17*a* of the handle adapted to be manually grasped to manipulate the head assembly. The head assembly also includes support means, such as wheels 19 at laterally opposite ends of the walls 14 and 15, and closing the open ended chamber defined by such walls. Strips 11 and 12 are sealingly connected to the walls 14 and 15, as via clamp brackets 22 and 123, and fasteners 24 and 25.

It will be noted that the strips 11 and 12 project downwardly in FIGS. 4 and 7 beneath the bottom levels 19*a* of the wheels, whereby in the absence of suction application to the interior 23 of the chamber formed by the head assembly, the strips engage the floor. If the strips are quite flexible, they may bend under the weight of the head assembly, so that the wheels do engage the floor however, the wheels do not project beneath the bottom levels of the strips to prevent their flexing engagement with the floor. For this purpose, the relative levels of the wheels may be upwardly adjusted, as by a nut 26 seen in FIG. 3. The nut is integral with a stem 27 which has threaded engagement at 28 with a bore in the head assembly, whereby the nut moves forwardly or reversely as it is turned. The lower portion of the nut bears against upper leg 29 of a bell crank 30, the latter including a laterally elongated pivot rod 31 and laterally spaced arms 32 which support the wheel axles. Accordingly, as the nut is advanced, the wheels are lowered, and vice versa. Rod 31 is loosely rotatably positioned by a guide sheath 33 attached to the head assembly. Adjustment of the wheels may thus be effected as related to the stiffness of the strips and as related to best cleaning effect, as will be seen.

Suction may be applied to the space 23 between the strips 11 and 12, as for example by a blower 86 having its inlet side connected with space 23 via duct 37 and hollow handle 17. See FIG. 8 in this regard. Suction causes the lowermost portions **11*b* and 12*b* of the strips 11 and 12 to flex, as the head assembly is displaced downwardly by amount "t" causing wheel 19 to rest on the floor surface. As the head assembly is then moved forwardly in one direction, as for example in the leftward direction of arrow 38, the strip lowermost portions 11*b* and 12*b* are flexed in the opposite, i.e. rightward direction. The leading strip 11*b* in that direction thus passes loose soils and bacteria relatively therebeneath into the space 23 between the strips, for suction removal. Note arrow 39 indicating air-flow beneath the lowermost portion 11*b* of the strip 11; also, note the lowermost portion of strip 12*b* scraping the floor surface and preventing air-flow from passing beneath it, into space 23. Some air may also enter space 23 via the small gaps 40** adjacent the wheels.

Means is also provided for applying cleaning liquid, as for example germicidal solution, to the floor surface to wet that surface in such spaced relation to the strips that when the head assembly and strips are bodily displaced in the opposite (rightward) longitudinal direction, the lower portions of the strips flex relatively in the one (leftward) direction; also, the leading strip **12*b* in that opposite direction then passes the applied liquid relatively beneath the strip and into the space 23 for suction removal. Such liquid application means may, with unusual advantage, include at least one spray nozzle, and preferably two nozzles 41 connected to the head assembly and directed to spray liquid downwardly onto surface 13 in spaced relation to the strips 11 and 12**.

The illustrated nozzles 41 each include a spray orifice 42 (see FIG. 5) directed longitudinally, and a deflection surface 43 facing the orifice to receive impingement of liquid and to deflect same in a fan-shaped spray pattern 44 seen in FIG. **5*a*. Surface 43 curves downwardly and laterally to cause the spray fan to flare downwardly and laterally, to extents as also shown by broken lines 44*a* in FIG. 6. Accordingly, the liquid droplets cling to the floor surface and do not appreciably spatter or splash, as is also shown from FIG. 8. Typically, the liquid is delivered to the nozzles as the head assembly moves leftwardly as seen in FIG. 8, leaving a wet swath 45 covering the floor to the right of the head. FIG. 9 shows the head assembly subsequently moving rightwardly in the direction of arrow 46, the liquid 45 relatively entering the space between the strips 11 and 12 via the gap beneath upwardly flexed lowermost portion 12*b*, and being sucked upwardly. Lowermost portion 11*b* of strip 11 drags on the floor surface 13 to block escape of any remanent liquid, whereby the latter 45*a* at the rightward edge of strip portion 11*b* may be sucked up as it accumulates. The floor surface 13*a* at the left of strip 11** is thereby left clean and substantially dry; also it is disinfected if germicidal solution has been used.

Referring to FIGS. 1 and 8, germicidal solution may be delivered to the nozzle via a flexible duct or line 60 and pump 61, the latter taking suction via inlet pipe **61*a* from a reservoir 62 of such liquid in tank 63. A control valve 64 in line 60 regulates the supply of solution to the nozzle. The two nozzles 41 may be supported by a nozzle carrier 65 to which duct 60 is centrally connected, as seen in FIG. 6. The illustrated tubular carrier or manifold extends transversely and is connected to that portion 17*b* of the handle or wand 17 proximate the head assembly. Valve 64 may be located at the upper end portion 17*a* of the S-shaped handle, and may include a lever 64*a* adapted to be finger actuated, as viewed in FIG. 1**.

Tank 63 is shown as mounted on an ambulatory carrier 66, which has wheels 67 to allow the carrier to be pulled about wherever the apparatus is to be used. A receiver tank on or in the carrier may be formed as by a flaccid bag 68 located within a well 80 on the carrier. The interior 81 of the bag receives discharge 83 from the handle 17 via line 37 and a separator 82. Such discharge may include dry bacteria and soils picked up off a dry hard surface floor, or bacteria in germicidal solution picked up off the floor. The discharged germicidal solution is retained in the bag 68 and it also receives dry bacteria discharged downwardly at 83, to kill same. Dry bacteria that is not trapped in the solution may be sucked toward outlet 84, which is in communication with the suction or inlet side 85 of blower 86. The latter operates continuously and produces suction communication to the head assembly 10, via the enclosed interior zone 87 of the carrier, separator 82, line 37, and handle 17. See also U.S. Pat. No. 3,896,520 in this regard.

A sub-micron filter 88 is typically located at or near the inlet to blower 86 to trap airborne bacteria, preventing exhausting thereof to the atmosphere.

Referring to FIG. 10, it shows the head assembly including strips 11 and 12 and wheels 19 being moved back and forth, as indicated by arrows 72 and 73, so that the back and forth flexing lowermost portions **11*b* and 12*b* of the strips scrub the floor surface 13 wetted by spray from the nozzles. The film of liquid is shown at 45*a* and 45*b* at opposite sides of the strips as a result of no suction application during scrubbing. Thereafter, suction may be applied to space 23 to cause pick-up of the liquid film. A suction ON-OFF control 75 may be located at the tank, in association with blower 86. Also, the blower 86 and pump 61 may be integral with or carried by the carrier 66**.

FIG. 6 shows bottom walls 70 of the head extending transversely and leading into the gooseneck opening 71 at location **70*a*. Walls 70 are at the level indicated at 70*b* in FIG. 4**.

The nozzles 41 have lateral side openings, as seen in FIGS. 7–10, to permit lateral fanning of the spray pattern. The nozzle carrier in FIG. 2 includes bracket elements 74 and 75 encompassing the lower end portion **17*b* of the handle, bracket portion 75 supporting ducts 65**.

In FIG. **3*a*, a swivel joint 90 is shown connected in the wand or handle 17 near the head assembly 10, enabling the operator to keep the head assembly 10 parallel to the floor surface while manipulating the handle to clean under furniture, cabinets, etc., with short legs. The joint 90 may be defined by adjacent flanges 91 and 92 on the end of handle 17 and the end of stub pipe 17***a'*, and a coupling sleeve 93 embracing the two flanges. Seals may be provided, if desired.

I claim:

1. In apparatus for removing loose soils and bacteria from a hard floor surface, the combination comprising (a) a head assembly including two upright, longitudinally spaced, resiliently flexible strips extending generally laterally horizontally in parallel relation; the strips projecting downwardly to engage the floor surface, (b) means for applying suction to the space between the strips, said means including a suction source including a suction line extending to said head assembly, (c) the head assembly including support means to engage the floor while the head assembly is bodily displaced longitudinally in one direction with the strips in such proximity to the floor surface that their lower edge portions are flexed in the opposite direction, whereby the leading strip in said one direction passes loose soils relatively therebeneath into the space between the strips for suction removal from said space, and (d) means for applying cleaning liquid to the floor surface to wet said surface in such spaced relation to the strips that when the head assembly and strips are bodily displaced in the opposite longitudinal direction the lower portions of the strips flex relatively in said one direction and the leading strip in said opposite direction passes applied liquid relatively therebeneath into the space between the strips for suction removal from said space, said means including at least one spray nozzle and a source of said liquid including a valve controlled duct communicating with said nozzle, (e) said nozzle located outside the space between said strips to spray said liquid in a fan-shaped spray pattern visibly and openly onto the floor surface in longitudinally spaced relation to said strips, (f) there being an elongated handle carrying both said head assembly and said nozzle, said duct and suction line associated with said handle.

2. The apparatus of claim 1 wherein said nozzle includes a spray orifice and a deflection surface facing said orifice to receive impingement of liquid and to deflect the impinging liquid in a fan-shaped spray pattern, the fan extending laterally relative to the nozzle and spaced from the head assembly in said opposite direction.

3. The apparatus of claim 2 wherein said elongated handle is connected with said head assembly intermediate the laterally opposite ends thereof, and wherein two of said spray nozzles are provided, said nozzles located at laterally opposite sides of that portion of the handle proximate the head assembly.

4. The apparatus of claim 3 including a nozzle carrier attached to that portion of the handle proximate the head assembly.

5. The apparatus of claim 4 including a swivel joint connected in said handle proximate the head assembly to allow the head assembly and nozzle carrier to swivel as a unit relative to the main extent of the handle.

6. In apparatus for removing loose soils and bacteria from a hard floor surface, the combination comprising (a) a head assembly including two upright, longitudinally spaced, resiliently flexible strips extending generally laterally horizontally in parallel relation, the strips projecting downwardly to engage the floor surface, (b) means for applying suction to the space between the strips, said means including a suction source including a suction line extending to said head assembly, (c) the head assembly including support means to engage the floor while the head assembly is bodily displaced longitudinally in one direction with the strips in such proximity to the floor surface that their lower edge portions are flexed in the opposite direction, whereby the leading strip in said one direction passes loose soils relatively therebeneath into the space between the strips for suction removal from said space, and (d) means for applying cleaning liquid to the floor surface to wet said surface in such spaced relation to the strips that when the head assembly and strips are bodily displaced in the opposite longitudinal direction the lower portions of the strips flex relatively in said one direction and the leading strip in said opposite direction passes applied liquid relatively therebeneath into the space between the strips for suction removal from said space, said means for applying cleaning liquid including two spray nozzles and a source of said liquid including a valve controlled duct communicating with said nozzles, (e) each nozzle including a spray orifice and a deflection surface facing said orifice to receive impingement of liquid and to deflect the impinging liquid in a fan-shaped spray pattern extending laterally relative to the nozzle and spaced from the head assembly in said opposite direction, (f) an elongated handle being connected with said head assembly intermediate the laterally opposite ends thereof, said nozzles located at laterally opposite sides of that portion of the handle proximate the head assembly, (g) and wherein said duct is attached to the handle and communicates with said nozzles to deliver cleaning liquid thereto, and a manually operable control valve connected with said duct and carried by the handle, remotely from said spray nozzles, said handle being tubular to thereby form a portion of said suction line to conduct removed soils and bacteria away from said head assembly.

7. The apparatus of claim 6 wherein said source of said liquid includes a source of germicidal solution connected with said duct.

8. The apparatus of claim 7 including a reservoir of germicidal solution, and said suction means conducting removed soils and bacteria to said reservoir.

9. The apparatus of claim 8 including an ambulatory carrier for said source of said germicidal solution and said reservoir.

10. The apparatus of claim 8 including a tank enclosing said reservoir and forming an interior zone outside said reservoir but inside the tank, the tank having an outlet via which air in said zone is exhausted, and a sub-micron filter associated with said outlet to remove bacteria from the air stream flowing from said zone to the exterior, via said outlet.

* * * * *